US012628893B1

(12) United States Patent
Backlin et al.

(10) Patent No.: US 12,628,893 B1
(45) Date of Patent: May 19, 2026

(54) MOISTURE REMOVAL APPARATUS

(71) Applicant: Open Space Labs Capital, LLC, Carlsbad, CA (US)

(72) Inventors: Zachary Ernest Backlin, Carlsbad, CA (US); Thomas Olin Koger, Ramona, CA (US); Douglas William Wierenga, Encinitas, CA (US)

(73) Assignee: Open Space Labs Capital, LLC, Carlsbad, CA (US)

( * ) Notice: Subject to any disclaimer, the term of this patent is extended or adjusted under 35 U.S.C. 154(b) by 0 days.

(21) Appl. No.: 19/215,643

(22) Filed: May 22, 2025

(51) Int. Cl.
*A41D 27/28* (2006.01)
*F04D 29/44* (2006.01)
*F04D 29/54* (2006.01)

(52) U.S. Cl.
CPC ..... *A41D 27/285* (2013.01); *F04D 29/441* (2013.01); *F04D 29/541* (2013.01)

(58) Field of Classification Search
CPC .... A41D 27/285; F04D 29/441; F04D 29/541
See application file for complete search history.

(56) References Cited

U.S. PATENT DOCUMENTS 3,121,877 A * 2/1964 Gintner ..... B25J 21/02 976/DIG. 339
4,768,293 A * 9/1988 Kaffka ..... A47L 23/205 392/383
5,179,790 A * 1/1993 Poulos ..... A47L 23/205 34/106
5,289,642 A * 3/1994 Sloan ..... A43D 3/1491 34/91
5,570,515 A * 11/1996 Schulte ..... F04D 29/4246 34/239
5,983,518 A * 11/1999 Ellenburg ..... D06F 59/04 34/106
8,365,431 B1 * 2/2013 Parish ..... F26B 21/008 34/106
8,696,300 B1 * 4/2014 Burke, Jr. ..... F04D 25/08 415/214.1
10,006,707 B1 * 6/2018 Wiley ..... A45D 20/14
11,952,708 B1 * 4/2024 Henry ..... F26B 9/003
11,957,293 B2 * 4/2024 Lin ..... A47L 23/205
12,408,814 B2 * 9/2025 Lin ..... A47L 23/20
2007/0193059 A1 * 8/2007 Carey ..... A47L 23/205 34/239

(Continued)

*Primary Examiner* — Aaron R Eastman
(74) *Attorney, Agent, or Firm* — Rimon PC

(57) ABSTRACT

Disclosed herein is a moisture removal system and more particularly to a non-intrusive based moisture removal apparatus for removing moisture from one of a single-opening article (gloves, footwear, helmets) or a multi-opening article (wet suits, jackets, protective garments. The moisture removal apparatus mainly includes a housing, an airflow-generating unit, a nozzle and a moisture exhaust regulating mechanism. The moisture removal apparatus is handheld and is easily portable. The moisture removal apparatus is reliable and is energy efficient due to reduced electric current consumption. The moisture removal apparatus uses low-volume ambient airflow for removing the moisture from the article. The moisture removal apparatus effectively removes the moisture from the articles without using hot air or high pressurized air or chemical agents/desiccants.

16 Claims, 7 Drawing Sheets

(56) References Cited

U.S. PATENT DOCUMENTS

| | | | | |
|---|---|---|---|---|
| 2016/0161183 | A1* | 6/2016 | Barnes | F26B 21/006 34/104 |
| 2016/0278459 | A1* | 9/2016 | Hilty | A41D 27/285 |
| 2016/0281289 | A1* | 9/2016 | McLoughlin | A45C 3/004 |
| 2019/0017430 | A1* | 1/2019 | Vierkant | F01P 7/026 |
| 2020/0079482 | A1* | 3/2020 | Bowman | F26B 21/001 |
| 2020/0256007 | A1* | 8/2020 | Schwab | F26B 21/008 |
| 2020/0309152 | A1* | 10/2020 | Sanford | F04D 29/601 |
| 2021/0222353 | A1* | 7/2021 | Durham | D06F 59/04 |
| 2024/0229346 | A1* | 7/2024 | Henry | D06F 59/04 |
| 2024/0263381 | A1* | 8/2024 | Lin | D06F 59/04 |
| 2024/0327095 | A1* | 10/2024 | Sawyer | A47L 23/02 |

* cited by examiner

MOISTURE REMOVAL APPARATUS

TECHNICAL FIELD

The disclosure generally relates to a moisture removal system and more particularly to a non-intrusive based moisture removal apparatus for removing moisture from one of a single-opening article (gloves, footwear, helmets) or a multi-opening article (wet suits, jackets, protective garments).

BACKGROUND

Moisture removal from personal gear and equipment such as wetsuits, footwear, and gloves is a critical requirement in various contexts, ranging from recreational to professional use. In particular, wetsuits which are commonly used in aquatic sports and underwater activities, are prone to retaining moisture for extended durations after use. Due to the nature of these activities, wetsuits are exposed to significant amounts of water and are typically made of thick insulating materials such as neoprene, which inherently trap moisture within their layers. If moisture is not effectively removed after use, it can lead to various complications, including microbial growth, unpleasant odors, material degradation, and discomfort upon reuse. Timely and effective drying not only preserves the hygiene and structural integrity of such personal gear/equipment but also enhances user's comfort and extends product lifespan. However, as the wetsuits are designed to provide thermal insulation, moisture often becomes trapped deep within their layers, making conventional drying devices and methods insufficient for removing the moisture. This results in prolonged drying times, during which the wetsuits remains damp, potentially leading to the aforementioned issues.

Conventional drying devices designed for footwears, gloves, and wetsuits, rely primarily on wired plug-in power sources and heating elements. While these drying devices are effective in some scenarios, they pose several inefficiencies limitations. First, the reliance on heating elements can lead to energy-intensive operations, which may not be the most sustainable solution. Additionally, the use of heat can sometimes be unsuitable for sensitive materials, such as neoprene, as high temperatures may cause material degradation over time. Second, many of these drying devices require either full or near-full insertion of the device into the interior space of the personal gear/equipment or are designed to work within contained or closed environments, which limits their adaptability and convenience. As a result, these conventional drying devices are often impractical for on-the-go usage or in environments where accessible power outlets are unavailable. Other conventional drying devices use pressurized air or chemical agents/desiccant to remove the moisture from such personal gear/equipment. As the aforementioned conventional drying devices are generally designed to work within closed or contained environments, they are subjected to higher energy consumption as well as producing excessive noise and are cumbersome to operate. The noise associated with these drying devices can be a significant inconvenience, particularly in environments where quiet operation is preferred, such as shared living spaces or professional settings. Additionally, the dependency on continuous electrical input and inefficient moisture removal techniques often results in longer drying times and higher energy consumption, making these drying devices less environmentally friendly and cost-effective in the long run.

Moreover, the drying devices are frequently designed with rigid formats and bulky enclosures that make them unsuitable for use in diverse situations. The inflexibility of such drying devices prevents them from being universally applicable across various personal gear/equipment with differing geometries and material properties. For example, the internal cavities of shoes and gloves present significant challenges to drying devices that are not capable of conforming to these unique spaces to provide effective removal of moisture. Similarly, wetsuits require airflow across its entire surface area, which is difficult to achieve with drying devices designed primarily for closed-volume personal gear/equipment. This lack of design versatility prevents conventional drying devices from addressing the varied requirements of different personal gear/equipment effectively. Further, the conventional drying devices can also be restrictive in terms of user experience and portability.

Therefore, there exists a need for a moisture removal apparatus which obviates the aforementioned drawbacks.

SUMMARY

One object of embodiments herein is to provide a non-intrusive-based moisture removal apparatus for easily removing moisture from a single-opening article (gloves, footwear, helmets) and a multi-opening article (wet suits, jackets, protective garments) without inserting the moisture removal apparatus into the interior cavity (interior space) of the article.

Another object of embodiments herein is to provide the moisture removal apparatus which effectively removes the moisture from the article by using low volume ambient airflow to the article.

Another object of embodiments herein is to provide the moisture removal apparatus configured for peripheral connection or adjacency connection or edge connection to the article without requiring access to the core internal space thereby resulting in a moisture removal process that is inherently quieter, more versatile, and significantly more energy efficient.

Another object of embodiments herein is to provide a universal/modular moisture removal apparatus which can be easily fitted with different sizes of access openings of various types of articles or personal gear/equipment with differing geometries and material properties.

Another object of embodiments herein is to provide a handheld moisture removal apparatus which is easily portable and is easy to install to the single-opening article and the multi-opening article from which moisture is to be removed.

Another object of embodiments herein is to provide the moisture removal apparatus which removes the moisture from the articles thereby enhancing comfort level of the user who would be wearing the article as the treated article is dry, and not wet, cold and foul-smelling.

Another object of embodiments herein is to provide the moisture removal apparatus, which is user friendly, especially for a novice.

Another object of embodiments herein is to provide the moisture removal apparatus which is reliable and is energy efficient due to reduced electric current consumption.

Another object of embodiments herein is to provide the moisture removal apparatus which break down odor-causing compounds, such as volatile organic compounds (VOCs), bacteria, fungi, or mildew, thereby enhancing hygiene, user comfort, and the freshness of the treated article as well as reducing the chances of illness or disease spread to the user.

Another object of embodiments herein is to provide the moisture removal apparatus for effectively removing moisture from the article without using hot air or high pressurized air or chemical agents/desiccant.

Another object of embodiments herein is to provide the moisture removal apparatus which effectively removes the moisture from the articles to prevent moisture exposure to the article for reducing the possibility of degradation of the article thereby enhancing the lifetime of the treated article.

These and other objects of embodiments herein will be better appreciated and understood when considered in conjunction with following description and accompanying drawings. It should be understood, however, that the following descriptions, while indicating embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments are illustrated in the accompanying drawings, throughout which like reference letters indicate corresponding parts in various figures. The embodiments herein will be better understood from the following description with reference to the drawings, in which.

DETAILED DESCRIPTION

Figure 1:
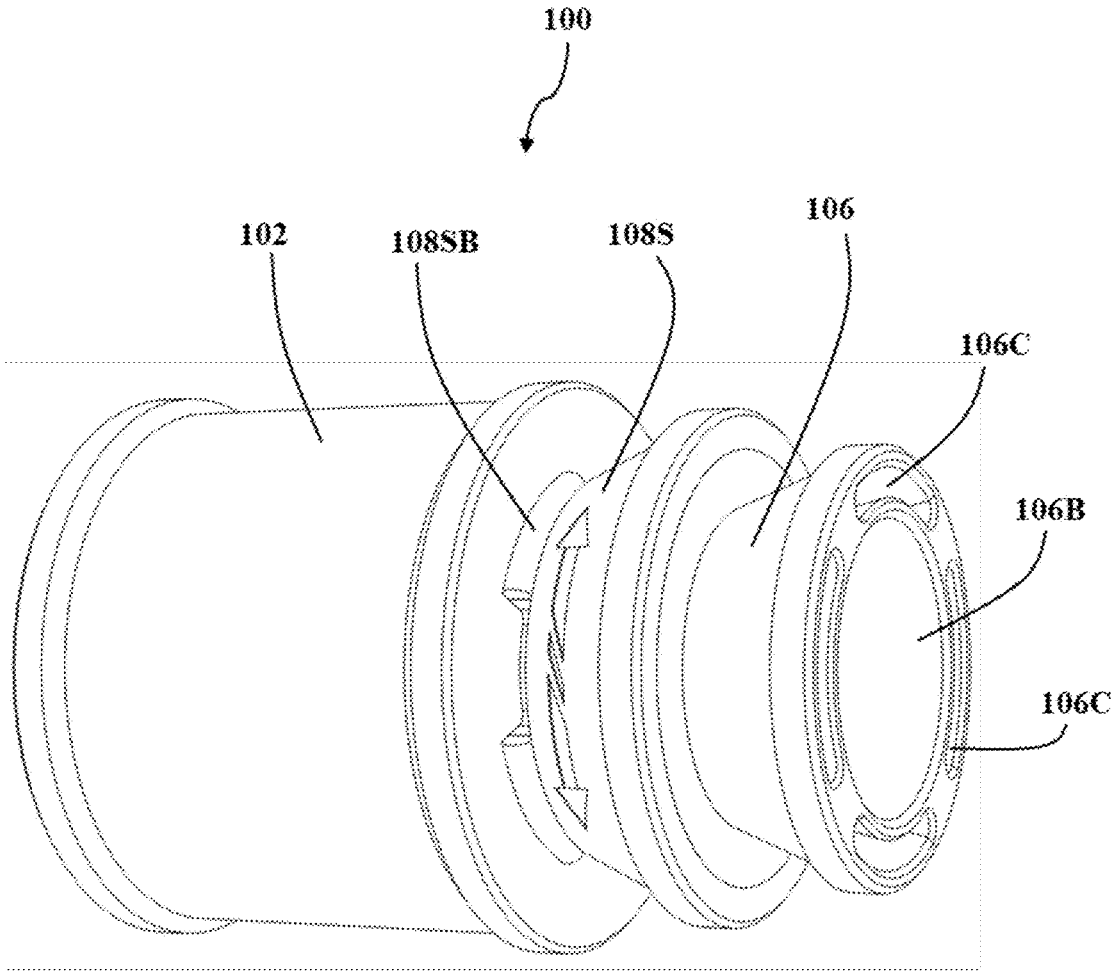
FIG. 1 depicts a perspective view of a moisture removal apparatus, according to embodiments as disclosed herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein achieve a non-intrusive-based moisture removal apparatus for easily removing moisture from a single-opening article and a multi-opening article without inserting the moisture removal apparatus into the interior cavity (interior space) of the article. Referring now to the FIGS. 1 through 7B, where similar reference characters denote corresponding features consistently throughout the figures, there are shown embodiments.

Figure 2:
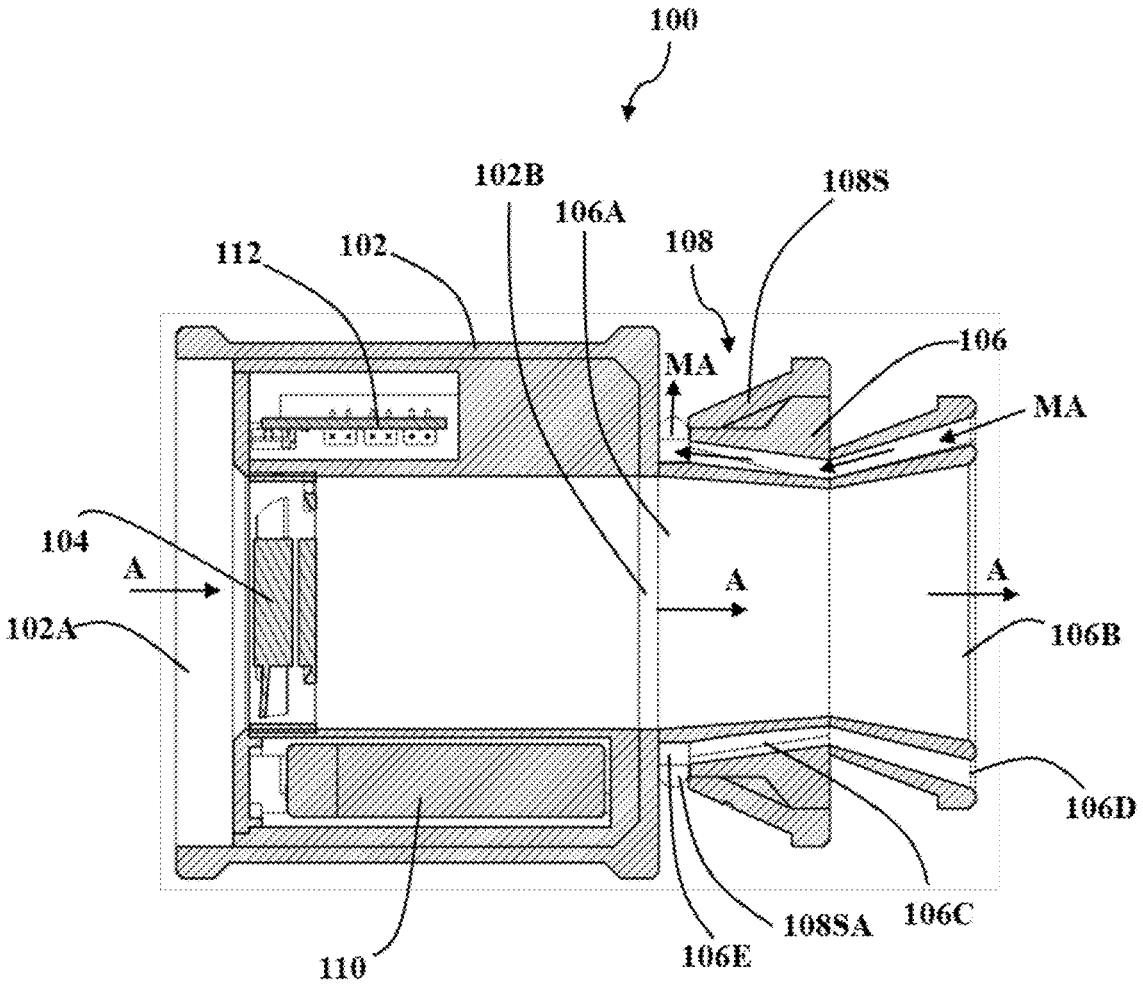
FIG. 2 depicts a sectional view of the moisture removal apparatus showing a movable moisture exhaust regulator in an open position, according to embodiments as disclosed herein.
Figure 4:
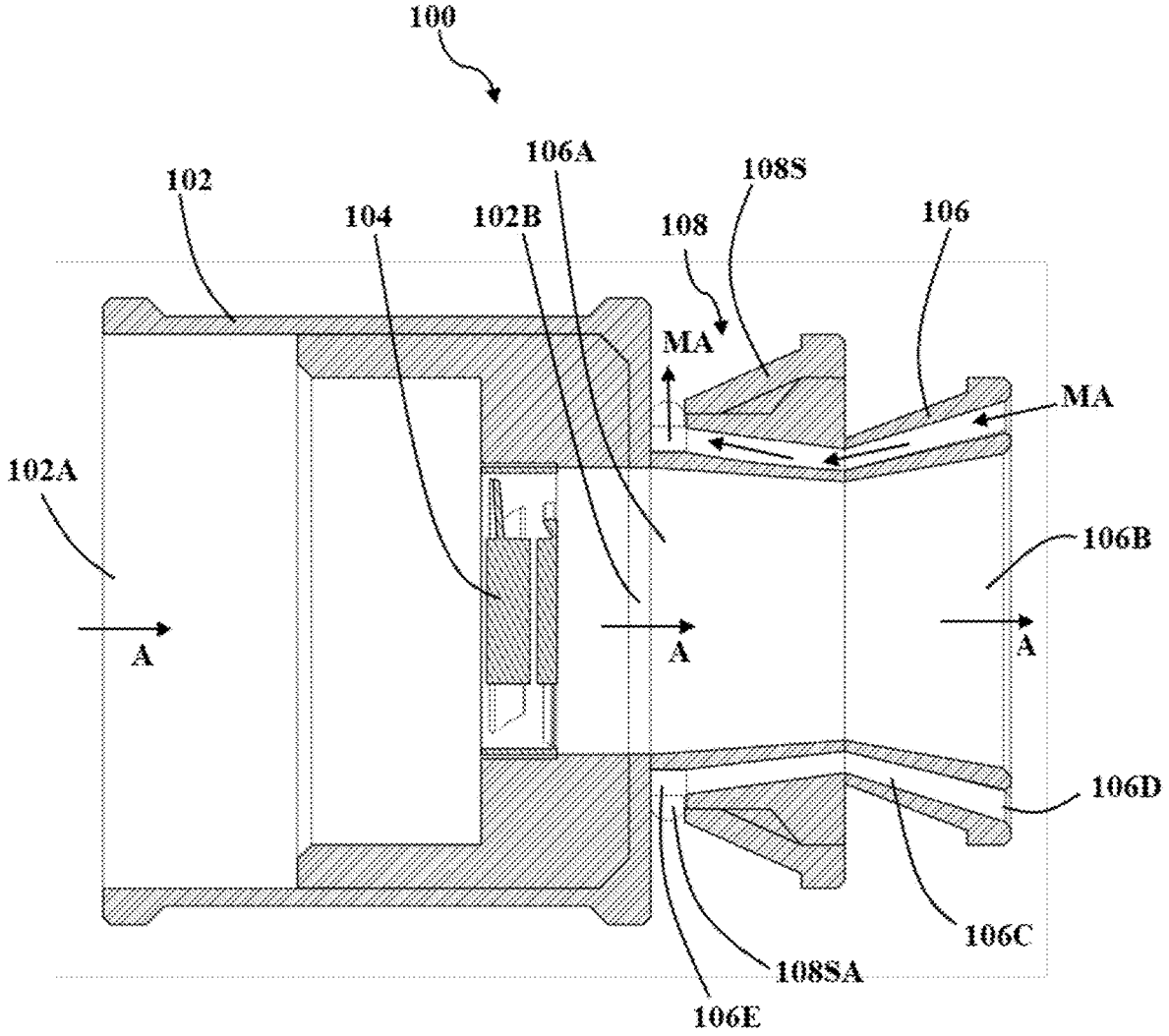
FIG. 4 depicts another sectional view of the moisture removal apparatus showing the movable moisture exhaust regulator in the open position, according to embodiments as disclosed herein.

FIGS. 2 and 4 depict sectional views of the moisture removal apparatus (100), according to embodiments as disclosed herein. In an embodiment, the moisture removal apparatus (100) comprises a housing (102), an airflow-generating unit (104), a nozzle (106), a moisture exhaust regulating mechanism (108), a power source (110), an on-board control unit (112), a user interface unit (114), a remote user interface device (116), a sensor module (118) and an odor neutralizing module (120). For the purpose of this description and case of understanding, the moisture removal apparatus (100) is explained herein below with reference to removable peripheral connection to the article (10, 20) for removing moisture from at least one of the multi-opening article (10) and the single-opening article (20). However, it is also within the scope of the disclosure to use/practice the components of the moisture removal apparatus (100) for removing moisture from any other personal gears/equipment, cabinets, consumer electronics, bedding, backpacks, luggage/bags, any other closed space based systems or open space based systems or vehicle interiors or enclosed spaces or any other applications without otherwise deterring the intended function of the moisture removal apparatus (100) as can be deduced from the description and corresponding drawings.

The moisture removal apparatus (100) is a non-intrusive-based moisture removal apparatus that facilitates the removal of moisture from the article (10, 20) having an internal cavity, without requiring the apparatus (100) or any of its functional components to be inserted into the internal volume (interior space) of the article (10, 20). Therefore, the moisture removal apparatus (100) achieves moisture removal through peripheral-based connection, adjacent-based connection, or edge-based connection to one or more access openings (10A, 20A) of the article (10, 20), and may operate using airflow, air circulation, or other non-heating-based methods, or desiccant free methods.

Figure 7A:
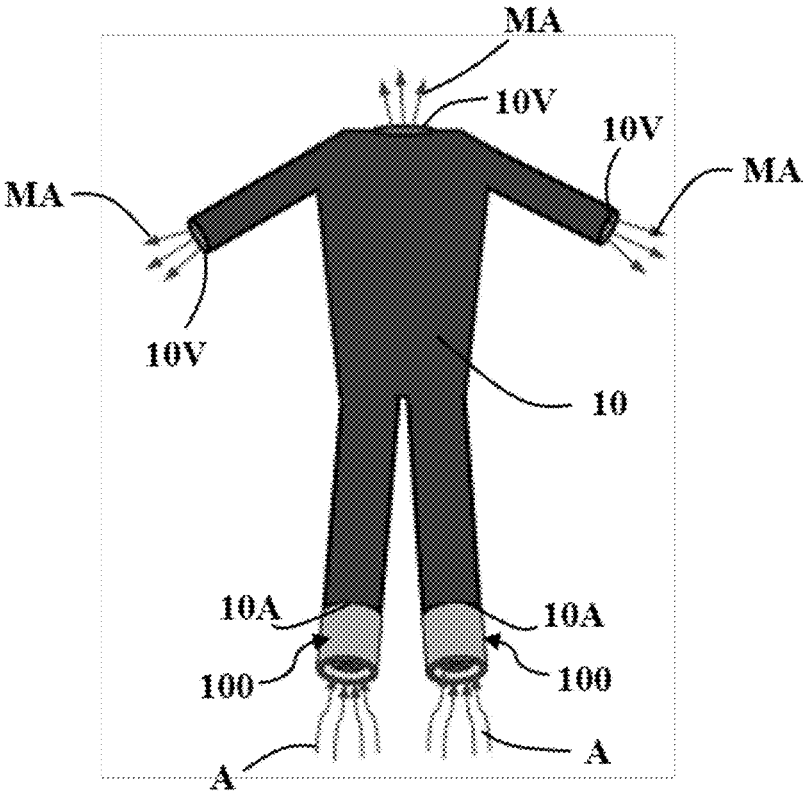
FIG. 7A illustrates the moisture removal apparatus configured for peripheral connection to a multi-opening article, according to embodiments as disclosed herein.

The multi-opening article (10) refers to a wearable article/gear or any object/article that comprises an internal cavity or enclosed volume accessible through two or more access openings (10A) (as shown in FIG. 7A). Each access opening (10A) of the article (10) allows access to the internal cavity (interior space) of the article (10). Non-limiting examples of the multi-opening article (10) includes wearable item/gear such as wetsuits, jackets, pants, aquatic garments, water-immersed wearables, wearable articles, personal protective equipment, or protective garments with sleeves, leg openings, neck openings, or zippers, as well as non-wearable enclosures such as bags, containers, or housings. The multi-opening article (10) is also called an open space-based article.

Figure 7B:
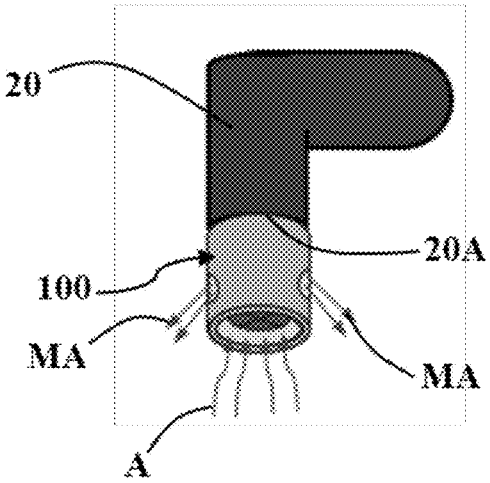
FIG. 7B illustrates the moisture removal apparatus configured for peripheral connection to a single-opening article, according to embodiments as disclosed herein.

The single-opening article (20) refers to wearable article/gear or any object/article that comprises an internal cavity or enclosed volume accessible through only one primary/access opening (20A) (as shown in FIG. 7B) of the article (20). The primary/access opening (20A) of the article (20) allows for the peripheral insertion of a corresponding portion of the nozzle (106), and the remainder of the article (20) remains closed or sealed. Non limiting examples of the single-opening article (20) includes footwear (shoes, boots, socks), handwear (gloves) and helmets. The single-opening article (20) is also called a closed space-based article.

The housing (102) is configured for housing/accommodating the airflow-generating unit (104), the power source (110), the on-board control unit (112), the user interface unit (114), the sensor module (118) and the odor neutralizing module (120). The housing (102) includes at least one air inlet (102A) (as shown in FIGS. 2 and 4) adapted to facilitate entry of ambient air (A) into the housing (102), and at least one air outlet (102B) (as shown in FIGS. 2 and 4) adapted to facilitate exit of ambient air (A) from the housing (102) to the nozzle (106) during operation of the airflow-generating unit (104).

The airflow-generating unit (104) is configured to draw the ambient air (A) into the housing (102) via its air inlet (102A) and direct the ambient air (A) to flow into or across the article (10, 20) via the air outlet (106B) of the nozzle (106) thereby facilitating removal of moisture from the article (10, 20). Further, the airflow-generating unit (104) is adapted to break down odor-causing compounds while removing the moisture from the article (10, 20). The ambient air (A) received by the article (10) is configured to flow into or across an interior space of the article (10) to remove the moisture entrained therein and subsequently the moist air (MA) is exhausted/vented via multiple openings (10V) (as shown in FIG. 7A) of the article (10) thereby facilitating removal of moisture from the article (10) when the article (10) connected to the moisture removal apparatus (100) is the multiple-opening article. For the purpose of this description and ease of understanding, the airflow-generating unit (104) is considered to be a low volume airflow fan configured to generate low-volume ambient airflow at a rate ranging from 2 to 10 CFM (cubic feet per minute). The operating noise level of the airflow-generating unit (104) does not exceed 25 dBA. In an embodiment, the airflow-generating unit (104) is located in the housing (102) in proximity or adjacent to its inlet (102A). In an embodiment, the airflow-generating unit (104) is located in the housing (102) in proximity or adjacent to its outlet (102B).

The nozzle (106) is configured to direct the ambient air (A) flow into or across the article (10, 20) during operation of the airflow-generating unit (104). The nozzle (106) is configured for removable peripheral connection to the article (10, 20) from which moisture is to be removed. In an embodiment, the nozzle (106) includes at least one air inlet (106A) (as shown in FIGS. 2, 4, 5A and 5B) adapted to facilitate entry of ambient air (A) from the housing (102) to the nozzle (106), and at least one air outlet (106B) (as shown in FIGS. 2, 4, 5A and 5B) adapted to facilitate exit of ambient air (A) from the nozzle (106) to the article (10, 20) during the operation of the airflow-generating unit (104). The air inlet (106A) of the nozzle (106) is connected to the air outlet (102B) of the housing (102). The air outlet (106B) of the nozzle (106) is in communication with at least one access opening (10A, 20A) (as shown in FIGS. 7A and 7B) of the article (10, 20). In one embodiment, the nozzle (106) includes a plurality of moist air bypass passages (106C) (as shown in FIGS. 1, 2, 4, 5A and 5B). Each moist air bypass passage (106C) of the nozzle (106) defines at least one moist air inlet (106D) in fluid communication with the article (20), and at least one moist air outlet (106E) located adjacent to a corresponding end of the movable moisture exhaust regulator (108S). The moist air inlet (106D) of each moist air bypass passage (106C) of the nozzle (106) is configured to facilitate entry of moist air (MA) from the article (20) to the moist air bypass passage (106C) of the nozzle (106). In another embodiment, the nozzle (106) can also include a single moist air bypass passage (106C) with at least one moist air inlet (106D) and a plurality of moist air outlets (106E). In another embodiment, an outlet section of the nozzle (106) is flexible, or a size of the air outlet (106B) of the nozzle (106) can be changed/adjusted in accordance with the different sizes of the access opening of various types of articles from which moisture is to be removed. In yet another embodiment, the moisture removal apparatus (100) includes removable inserts (not shown) of various air outlet sizes in which the corresponding removable insert can be connected with the air outlet (106B) of the nozzle (106) such that an air outlet of the corresponding removable insert (not shown) can be easily peripherally connected with the different sizes of the access opening of various types of articles. This modularity of the moisture removal apparatus (100) allows for universal removable peripheral connection across various types of articles or personal gear/equipment with differing geometries and material properties.

Figure 5A:
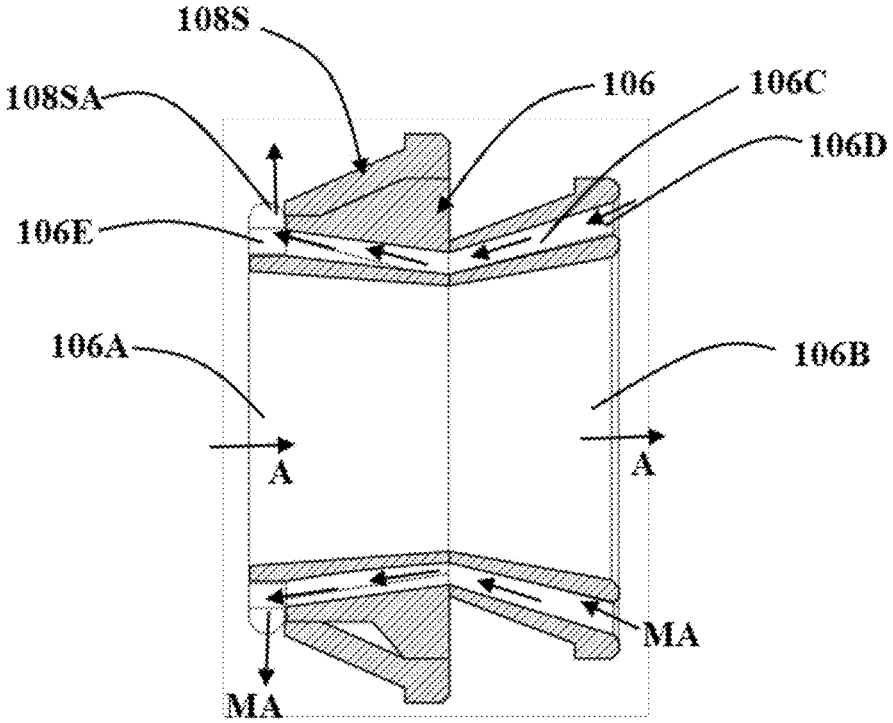
FIG. 5A depicts a sectional view of the movable moisture exhaust regulator positioned onto a nozzle of the moisture removal apparatus showing the exhausting/venting of moist air when the movable moisture exhaust regulator is in the open position, according to embodiments as disclosed herein.
Figure 5B:
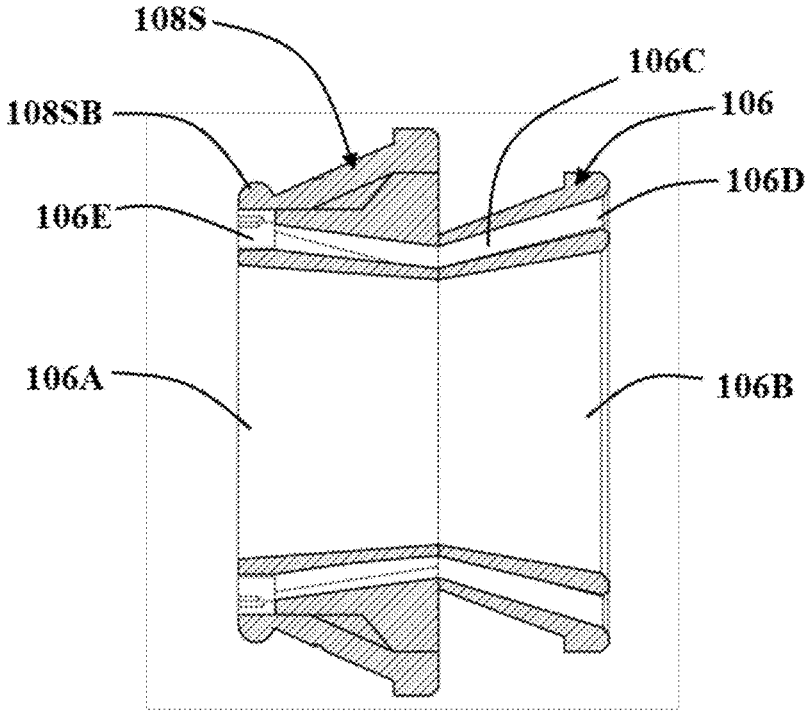
FIG. 5B illustrates the movable moisture exhaust regulator in a closed position with respect to the nozzle, according to embodiments as disclosed herein.

The moisture exhaust regulating mechanism (108) is configured to exhaust/vent the moist air. In an embodiment, moisture exhaust regulating mechanism (108) includes a movable moisture exhaust regulator (108S) (as shown in FIGS. 1, 2, 4, 5A and 5B) movably positioned onto the nozzle (106). The movable moisture exhaust regulator (108S) is configured to be moved to one of an open position (as shown in FIGS. 2, 4 and 5A) and a closed position (moist air exhaust position (as shown in FIG. 5B). In the closed position, the movable moisture exhaust regulator (108S) is configured to close the moist air outlets (106E) of the nozzle (106). In the open position (moist air exhaust position), the movable moisture exhaust regulator (108S) is configured to allow the moist air outlets (106E) of the nozzle (106) to vent/exhaust the moist air (MA) when the article (20) connected to the moisture removal apparatus (100) is the single-opening article. The movable moisture exhaust regulator (108S) remains in the closed position when the moist air (MA) vented/exhausted via the multiple openings (10V) of the article (10) when the article (10) connected to the moisture removal apparatus (100) is the multi-opening article. Further, the movable moisture exhaust regulator (108S) includes a plurality of moist air blocking members (108SB) (as shown in FIGS. 1 and 5B), wherein each moist air blocking member (108SB) is configured to align with the corresponding moist air outlet (106E) of the nozzle (106) thereby blocking or closing the corresponding moist air outlet (106E) of the nozzle (106) when the movable moisture exhaust regulator (108S) is in the closed position. Furthermore, the movable moisture exhaust regulator (108S) includes a plurality of moist air outlets (108SA) (as shown in FIGS. 2 and 4), wherein each moist air outlet (108SA) is defined in between corresponding adjacent moist air blocking members (108SB), wherein each moist air outlet (108SA) is configured to align with the corresponding each moist air outlet (106E) of the nozzle (106) for venting/ exhausting the moist air (MA) when the movable moisture exhaust regulator (108S) is in the open position.

Figure 6:
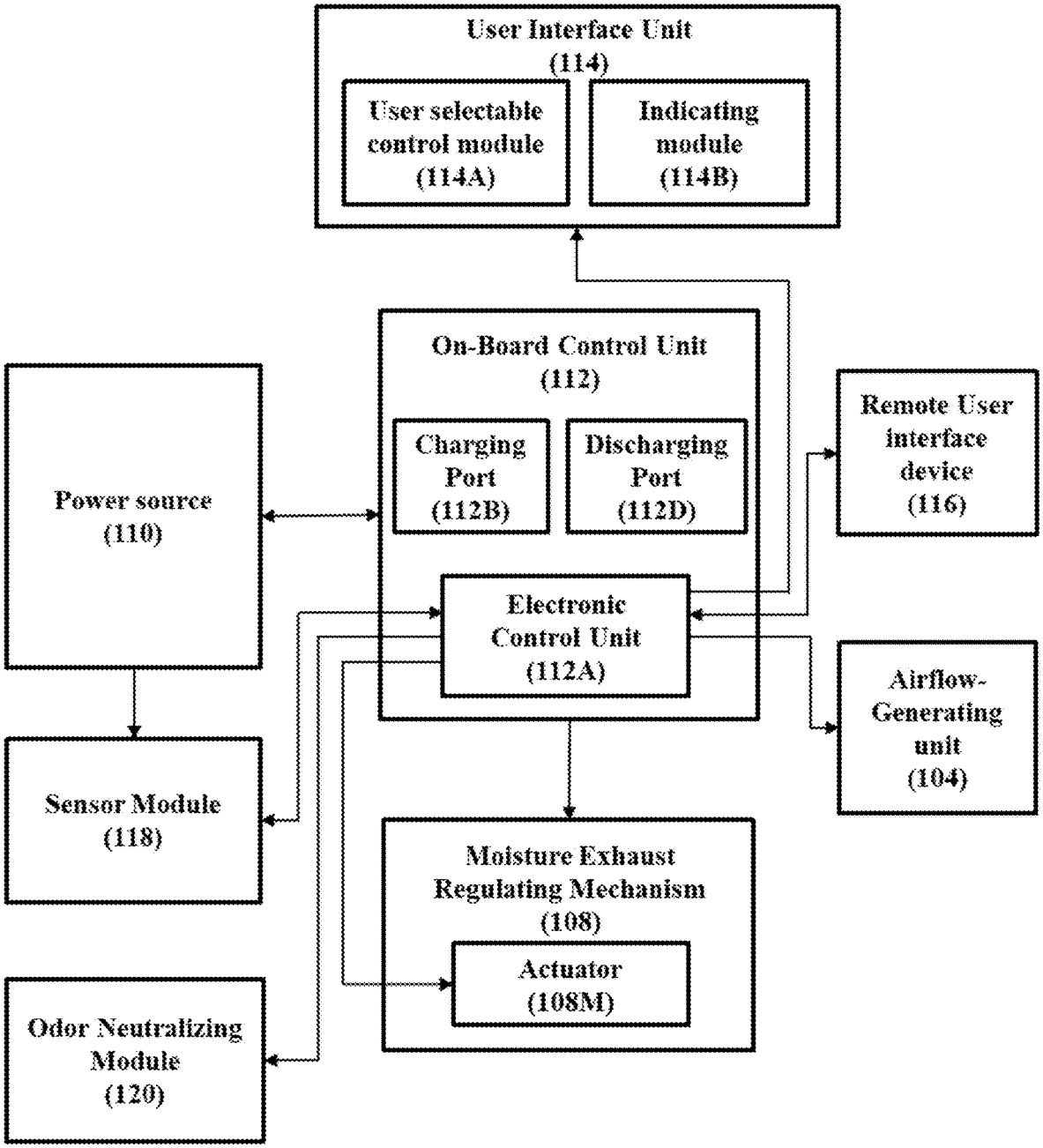
FIG. 6 depicts a block diagram of an on-board control unit in communication with a user interface unit, a power source, a sensor module, an odor neutralizing module, a remote user interface device and an actuator of the moisture exhaust regulating mechanism of the moisture removal apparatus, according to embodiments as disclosed herein.

In one embodiment, the movable moisture exhaust regulator (108S) is manually moved to one of the open position and the closed position. In another embodiment, the moisture exhaust regulating mechanism (108) includes an actuator (108M) (as shown in FIG. 6) configured to move the movable moisture exhaust regulator (108S) to one of the open position and the closed position. In one embodiment, the actuator (108M) is a rotary actuator. In another embodiment, the actuator (108M) is a linear actuator.

Figure 3:
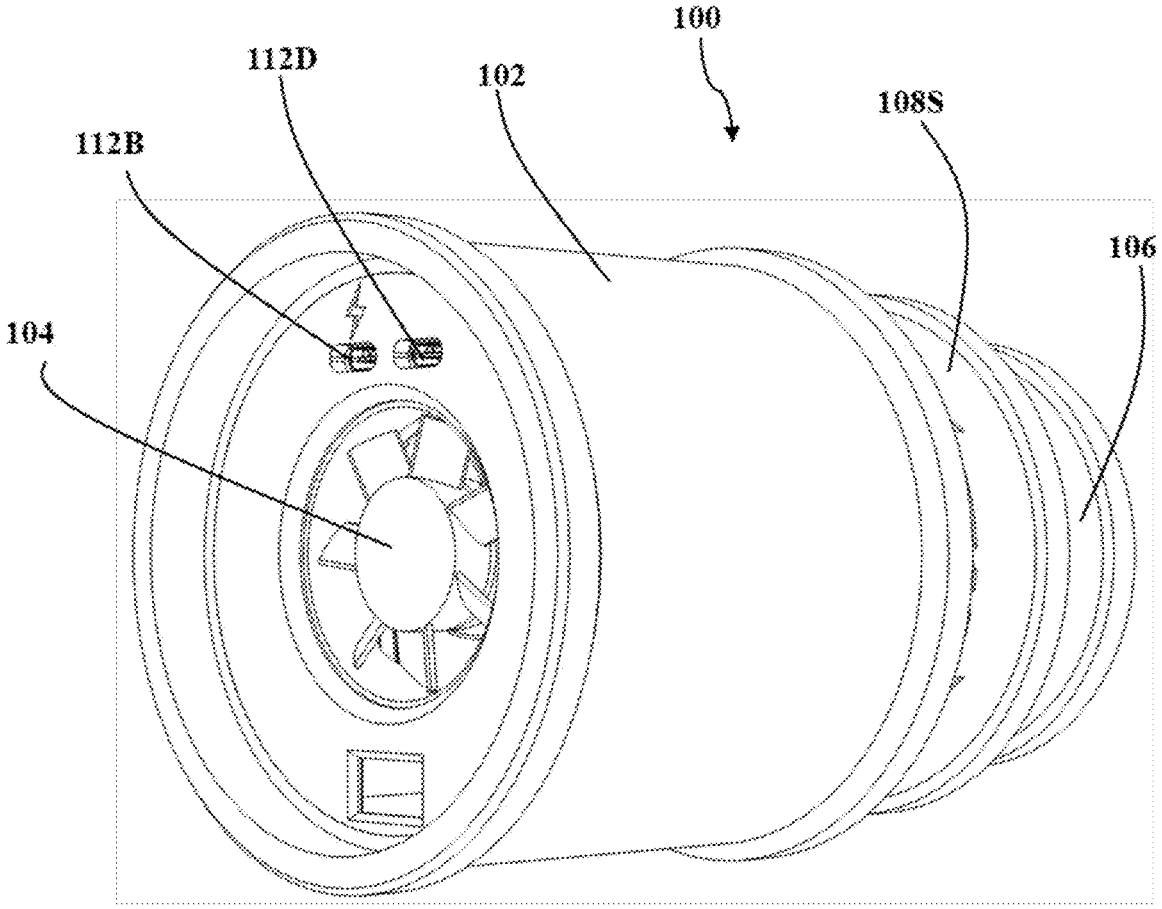
FIG. 3 depicts another perspective view of the moisture removal apparatus showing a charging port and a discharging port, according to embodiments as disclosed herein.

The power source (110) is configured to supply electric current to the airflow-generating unit (104), the sensor module (118) and the odor neutralizing module (120) via an electronic control unit (ECU) (112A) of the on-board control unit (112). In another embodiment, the power source (110) is configured to supply electric current to the airflow-generating unit (104) when the ECU (112A) is not present in the apparatus (100) (i.e. basic version of the apparatus (100). In one embodiment, the power source (110) is a plug-in power source. In another embodiment, the power source (110) is a rechargeable battery that is integrated with the moisture removal apparatus (100). The rechargeable battery based power source (110) can be charged through AC supply or through a solar panel. The on-board control unit (112) is located in the housing (102). The electronic control unit (ECU) (112A) is configured to be coupled to the power source (110), the airflow-generating unit (104), the user interface unit (114), the sensor module (118) and the odor neutralizing module (120). The ECU (112A) is configured to operate the airflow-generating unit (104) when the ECU (112A) receives signal(s) or command(s) from one of the user interface unit (114) or a remote user interface device (116) (as shown in FIG. 6) or the sensor module (118). The remote user interface device (116) is configured for wired or wireless communication with the ECU (112A). Further, the on-board control unit (112) includes a charging port (112B) (as shown in FIGS. 3 and 6) adapted to facilitate charging of the power source (110). The on-board control unit (112) includes a discharging port (112D) (as shown in FIGS. 3 and 6) adapted to facilitate electric power supply to the remote user interface device (116) or external devices. For the purpose of this description and ease of understanding, the remote user interface device (116) is considered to be one of a smartphone, a laptop, a tablet, a smart watch, remote controller, and so on.

The user interface unit (114) is provided on the housing (102) and is coupled to the ECU (112A) of the on-board control unit (112). The user interface unit (114) includes a user selectable control module (114A) coupled to the ECU (112A) of the on-board control unit (112). The user selectable control module (114A) includes user selectable controls (not shown) configured for selecting at least one of an operational status (ON or OFF) of the airflow-generating unit (104), an air flow rate (CFM) of the airflow-generating unit (104), a speed level (low, medium, high, or level 1 to 3, or rpm) of the airflow-generating unit (104), operating modes (auto or continuous or pulse or drying) of the airflow-generating unit (104), and an operational status (ON or OFF) of the odor neutralizing module (120), and an operational status (ON or OFF) of the actuator (108M) of the moisture exhaust regulating mechanism (108). For the purpose of this description and ease of understanding, the user selectable controls of the user selectable control module (114A) of the user interface unit (114) are considered to be buttons, switches, knobs, levers, touchscreen controls or any other hand operated controls.

The sensor module (118) is in communication with the ECU (112A) of the on-board control unit (112), wherein the sensor module (118) is configured to detect/sense at least one of humidity level in the article (10, 20), an odor level in the article (10, 20), a parameter relevant to detecting type of article (single-opening article or multi-opening article), and accordingly the sensor module (118) sends the sensed data(s)/signal(s) to the ECU (112A). The sensor module (118) may also be configured to detect pressure and temperature in the article, and pressure and flow rate of ambient air that is drawn into the article (10, 20). In one embodiment, the sensor module (118) is located externally to the housing (102). In another embodiment, the sensor module (118) is located inside the housing (102) at or near the air outlet (102B) of the housing (102). In another embodiment, the sensor module (118) is located in the moist air bypass passage (106C) of the nozzle (106). However, it is also within the scope of the disclosure to position the sensor module (118) at or near the air outlet (106B) or air inlet (106A) of the nozzle, or any other location inside the housing (102) without otherwise deterring the intended function of the sensor module (118) as can be deduced from the description and corresponding drawings.

The odor neutralizing module (120) is in communication with the ECU (112A) of the on-board control unit (112), wherein the odor neutralizing module (120) is configured for reducing or neutralizing undesirable odors present in the article (10, 20) when the odor neutralizing module (120) is operated by the ECU (112A). Non-limiting examples of the odor neutralizing module (120) includes ozone generation, ultraviolet (UV) sterilization, ionization, activated carbon or chemical filtration, fragrance dispersion systems. The odor neutralizing module (120) is used to target and break down odor-causing compounds, such as volatile organic compounds (VOCs), bacteria, fungi, or mildew, thereby enhancing hygiene, user comfort, and the freshness of the treated article (10, 20). In one embodiment, the odor neutralizing module (120) is located at or near the air outlet (102B) of the housing (102). In another embodiment, the odor neutralizing module (120) is located at or near the air outlet (106B) of the nozzle (106). In yet another embodiment, the odor neutralizing module (120) is located at or near the airflow-generating unit (104). However, it is also within the scope of the disclosure to position the odor neutralizing module (120) anywhere in between the airflow-generating unit (104) and the air outlet (106B) of the nozzle (106) without otherwise deterring the intended function of the odor neutralizing module (120) as can be deduced from the description and corresponding drawings.

Further, the user interface unit (114) includes an indicating module (114B) (as shown in FIG. 6) coupled to the ECU (112A) of the on-board control unit (112), wherein the indicating module (114B) is configured for indicating at least one of the selected operational status of the airflow-generating unit (104), current air flow rate of the airflow-generating unit (104), selected speed level of the airflow-generating unit (104), selected operating mode of the airflow-generating unit (104), a humidity level in the article (10, 20), detected odor level in the article (10, 20), type of article, operational status of the actuator (108M) of the moisture exhaust regulating mechanism (108), a battery charge level, a battery temperature, a battery health, a battery voltage, a battery estimated remaining runtime and a battery charging status. The indicating module (114B) is at least one of a display unit, light emitting diodes (LEDs), a touchscreen with integrated user selectable controls, an audio unit and a combination thereof. The user selectable control module (114A) is at least one of a separate module that is coupled to ECU (112A) of the on-board control unit (112), or an integral part of the indicating module (114B).

Further, the ECU (112A) of the on-board control unit (112) is in communication with the actuator (108M) of the moisture exhaust regulating mechanism (108). The ECU (112A) is configured to determine the type of article based on one of data/signal from the user selectable control module (114A), or the data/signal corresponding to the parameter relevant to detecting the type of article received from the sensor module (118) or the remote user interface device (116), and accordingly the ECU (112A) is configured to operate the actuator (108M) to move the movable moisture exhaust regulator (108S) to one of the closed position and the open position when the article (10, 20) coupled to the moisture removal apparatus (100) is one of the multi-opening article (10) and the single-opening article (20) respectively.

The technical advantages of the moisture removal apparatus (100) are as follows. The moisture removal apparatus (100) is non-intrusive so as to easily remove the moisture from the article (10, 20) without inserting the moisture removal apparatus (100) into the interior cavity (interior space) of the article (10, 20). The moisture removal apparatus (100) effectively removes the moisture from the article by using low volume ambient airflow to the article (10, 20). The moisture removal apparatus (100) is handheld and is easily portable and is easy to install to the single-opening article and the multi-opening article from which moisture is to be removed. The moisture removal apparatus (100) is reliable and is energy efficient due to reduced electric current consumption. The moisture removal apparatus (100) is user friendly, especially for a novice. The moisture removal apparatus (100) removes the moisture from the articles (10, 20) thereby enhancing comfort level of the user who would be wearing the article (10, 20) as the treated article (10, 20) is dry, and not wet, cold and foul-smelling. The moisture removal apparatus (100) effectively removes the moisture from the articles (10, 20) without using hot air or high pressurized air or chemical agents/desiccants. The moisture removal apparatus (100) is configured for peripheral connection or adjacency connection or edge connection to the article without requiring access to the core internal space thereby resulting in a moisture removal process that is inherently quieter, more versatile, and significantly more energy efficient. The moisture removal apparatus is modular in design such that the apparatus can be easily fitted with different sizes of access openings of various types of articles or personal gear/equipment with differing geometries and material properties. The moisture removal apparatus (100) is used for breaking down odor-causing compounds, such as volatile organic compounds (VOCs), bacteria, fungi, or mildew, thereby enhancing hygiene, user comfort, and the freshness of the treated article (10, 20). The moisture removal apparatus (100) effectively removes the moisture from the articles (10, 20) to prevent moisture exposure to the article (10, 20) for reducing the possibility of degradation of the article (10, 20) thereby enhancing the lifetime of the treated article (10, 20).

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of embodiments, those skilled in the art will recognize that the embodiments herein can be practiced with modifications within the spirit and scope of the embodiments as described herein.

What is claimed is:

1. A moisture removal apparatus (100) comprising:

a housing (102) having at least one air inlet (102A) and at least one air outlet (102B);

an airflow-generating unit (104) positioned in the housing (102);

a nozzle (106) configured for removable peripheral connection to an article (10,20), without insertion into the article's interior volume, from which moisture is to be removed, wherein the nozzle (106) includes:

at least one air inlet (106A) connected to the air outlet (102B) of the housing (102); and at least one air outlet (106B) in communication with at least one access opening (10A, 20A) of the article (10, 20); and a moisture exhaust regulating mechanism (108) comprising a movable moisture exhaust regulator (108S) movably positioned onto the nozzle (106).

2. The moisture removal apparatus (100) as claimed in claim 1, wherein the nozzle (106) includes at least one moist air bypass passage (106C) having:

at least one moist air inlet (106D) in fluid communication with the article (10); and a plurality of moist air outlets (106E) located adjacent to a corresponding end of the movable moisture exhaust regulator (108S).

3. The moisture removal apparatus (100) as claimed in claim 2, wherein the moist air inlet (106D) of the at least one moist air bypass passage (106C) of the nozzle (106) is configured to facilitate entry of moist air (MA) from the article (20) to the moist air bypass passage (106C) of the nozzle (106); and the movable moisture exhaust regulator (108S) is configured to be moved to one of:

a closed position in which the movable moisture exhaust regulator (108S) is configured to close the moist air outlets (106E) of the nozzle (106); and an open position in which the movable moisture exhaust regulator (108S) is configured to allow the moist air outlets (106E) of the nozzle (106) to exhaust/vent the moist air (MA) when the article (20) connected to the moisture removal apparatus (100) is a single-opening article.

4. The moisture removal apparatus (100) as claimed in claim 3, wherein the movable moisture exhaust regulator (108S) includes:

a plurality of moist air blocking members (108SB), wherein each moist air blocking member (108SB) is configured to align with the corresponding moist air outlet (106E) of the nozzle (106) thereby blocking or closing the corresponding moist air outlet (106E) of the nozzle (106) when the movable moisture exhaust regulator (108S) is in the closed position; and a plurality of moist air outlets (108SA), wherein each moist air outlet (108SA) is defined in between corresponding adjacent moist air blocking members (108SB), wherein each moist air outlet (108SA) is configured to align with the corresponding each moist air outlet (106E) of the nozzle (106) for venting/ exhausting the moist air (MA) when the movable moisture exhaust regulator (108S) is in the open position.

5. The moisture removal apparatus (100) as claimed in claim 4, wherein the movable moisture exhaust regulator (108S) is manually moved to one of the open position and the closed position.

6. The moisture removal apparatus (100) as claimed in claim 1, wherein the airflow-generating unit (104) is configured to draw ambient air (A) into the housing (102) via its air inlet (102A) and directs the ambient air (A) to flow into or across the article (10, 20) via the air outlet (106B) of the nozzle (106) thereby facilitating removal of moisture from the article (10, 20).

7. The moisture removal apparatus (100) as claimed in claim 6, wherein the ambient air (A) received by the article (10) is configured to flow into or across an interior space of the article (10) to carry away the moisture thereof and subsequently the moist air (MA) is exhausted/vented via multiple openings (10V) of the article (10) thereby facilitating removal of moisture from the article (10) when the article (10) connected to the moisture removal apparatus (100) is a multiple-opening article.

8. The moisture removal apparatus (100) as claimed in claim 7, wherein the movable moisture exhaust regulator (108S) remains in the closed position when the moist air (MA) exhausted/vented via the multiple openings (10V) of the article (10) when the article (10) connected to the moisture removal apparatus (100) is the multi-opening article.

9. The moisture removal apparatus (100) as claimed in claim 6, wherein the airflow-generating unit (104) is a low volume airflow fan configured to generate low-volume ambient airflow at a rate ranging from 2 to 10 CFM (cubic feet per minute);

the airflow-generating unit (104) is adapted to remove the odor while removing the moisture from the article (10, 20); and the nozzle (106) is configured to direct the ambient air (A) flow into or across the article (10, 20) during operation of the airflow-generating unit (104).

10. The moisture removal apparatus (100) as claimed in claim 1, wherein the moisture exhaust regulating mechanism (108) includes an actuator (108M) configured to move the movable moisture exhaust regulator (108S) to one of an open position and a closed position, wherein the actuator (108M) is one of a linear actuator or a rotary actuator.

11. The moisture removal apparatus (100) as claimed in claim 10, wherein an electronic control unit (ECU) (112A) of an on-board control unit (112) is in communication with the actuator (108M) of the moisture exhaust regulating mechanism (108), wherein the ECU (112A) is configured to determine the type of article based on one of date/signal from a user selectable control module (114A), or data/signal corresponding to a parameter relevant to detecting the type of article received from a sensor module (118) or a remote user interface device (116), and accordingly the ECU (112A) is configured to operate the actuator (108M) to move the movable moisture exhaust regulator (108S) to one of the closed position and the open position when the article (10, 20) coupled to the moisture removal apparatus (100) is one of a multi-opening article (10) and a single-opening article (20) respectively.

12. The moisture removal apparatus (100) as claimed in claim 1, wherein:

a power source (110) configured to supply electric current to the airflow-generating unit (104), wherein the power source (110) is one of a plug-in power source or a rechargeable battery that is integrated with the moisture removal apparatus (100), wherein the moisture removal apparatus (100) is portable.

13. The moisture removal apparatus (100) as claimed in claim 1, wherein the moisture removal apparatus (100) includes:

an on board control unit (112) having an electronic control unit (ECU) (112A) configured to be coupled to a power source (110) and the airflow generating unit (104); and a user interface unit (114) coupled to the ECU (112A) of the on-board control unit (112), wherein the ECU (112A) is configured to operate the airflow-generating unit (104) when the ECU (112A) receives signal(s) or command(s) from one of the user interface unit (114) or a remote user interface device (116), wherein the remote user interface device (116) is configured for wired or wireless communication with the ECU (112A).

14. The moisture removal apparatus (100) as claimed in claim 13, wherein the moisture removal apparatus (100) includes:

an odor neutralizing module (120) in communication with the ECU (112A) of the on-board control unit (112), wherein the odor neutralizing module (120) is configured for reducing or neutralizing undesirable odors present in the article (10, 20) when the odor neutralizing module (120) is operated by the ECU (112A); and a sensor module (118) in communication with the ECU (112A) of the on-board control unit (112), wherein the sensor module (118) is configured to detect/sense at least one of humidity level in the article (10, 20), an odor level in the article (10, 20), a parameter relevant to detecting type of article (single-opening article or multi-opening article), and accordingly the sensor module (118) sends the sensed data(s)/signal(s) to the ECU (112A).

15. The moisture removal apparatus (100) as claimed in claim 13, wherein the user interface unit (114) includes:

a user selectable control module (114A) coupled to the ECU (112A) of the on-board control unit (112), wherein the user selectable control module (114A) is configured for selecting at least one of an operational status (ON or OFF) of the airflow-generating unit (104), an air flow rate (CFM) of the airflow-generating unit (104), a speed level of the airflow-generating unit (104), operating modes (auto or continuous or pulse or drying) of the airflow-generating unit (104), and an operational status (ON or OFF) of the odor neutralizing module (120); and an indicating module (114B) coupled to the ECU (112A) of the on-board control unit (112), wherein the indicating module (114B) is configured for indicating at least one of the selected operational status of the airflow-generating unit (104), current air flow rate of the airflow-generating unit (104), selected speed level of the airflow-generating unit (104), selected operating mode of the airflow-generating unit (104), a humidity level in the article (10, 20), detected odor level in the article (10, 20), type of article, a battery charge level, a battery temperature, a battery health, a battery voltage, a battery estimated remaining runtime and a battery charging status, wherein the user selectable control module (114A) is at least one of a separate module that is coupled to the ECU (112A) of the on-board control unit (112), or an integral part of the indicating module (114B); and the indicating module (114B) is at least one of a display unit, light emitting diodes (LEDs), a touchscreen with integrated user selectable controls, an audio unit and a combination thereof.

16. A moisture removal apparatus (100) comprising:

a housing (102) having at least one air inlet (102A) and at least one air outlet (102B);

an airflow-generating unit (104) positioned in the housing (102);

an on-board control unit (112) having an electronic control unit (ECU) (112A) configured to be coupled to a power source (110) and the airflow-generating unit (104);

an odor neutralizing module (120) in communication with the ECU (112A) of the on-board control unit (112), wherein the odor neutralizing module (120) is configured for reducing or neutralizing undesirable odors present in an article (10, 20) when the odor neutralizing module (120) is operated by the ECU (112A);

a sensor module (118) in communication with the ECU (112A) of the on-board control unit (112), wherein the sensor module (118) is configured to detect/sense at least one of humidity level in the article (10, 20), an odor level in the article (10, 20), a parameter relevant to detecting type of article (single-opening article or multi-opening article), and accordingly the sensor module (118) sends the sensed data(s)/signal(s) to the ECU (112A);

a nozzle (106) configured for removable peripheral connection to the article (10, 20) from which moisture is to be removed, wherein the nozzle (106) includes:

at least one air inlet (106A) connected to the air outlet (102B) of the housing (102); and at least one air outlet (106B) in communication with at least one access opening (10A, 20A) of the article (10, 20); and a moisture exhaust regulating mechanism (108) comprising a movable moisture exhaust regulator (108S) movably positioned onto the nozzle (106).

* * * * *